US007816302B2

(12) United States Patent
Hammerslag

(10) Patent No.: US 7,816,302 B2
(45) **Date of Patent: *Oct. 19, 2010**

(54) PRINTABLE IDENTIFICATION MEDIUM FOR USE WITH THERMAL PRINTERS

(75) Inventor: Edward D. Hammerslag, Thousand Oaks, CA (US)

(73) Assignee: Precision Dynamics Corporation, San Fernando, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/534,373

(22) Filed: Aug. 3, 2009

(65) Prior Publication Data

US 2009/0298687 A1 Dec. 3, 2009

Related U.S. Application Data

(63) Continuation of application No. 12/029,060, filed on Feb. 11, 2008.

(51) Int. Cl.
*B41M 5/42* (2006.01)

(52) U.S. Cl. ..... 503/226; 427/150; 427/152; 503/200

(58) Field of Classification Search ..... None
See application file for complete search history.

(56) References Cited

U.S. PATENT DOCUMENTS 5,663,115 A * 9/1997 Naito et al. ..... 503/201
5,665,675 A * 9/1997 Nagai et al. ..... 503/216
6,479,431 B1 * 11/2002 McFall et al. ..... 503/200

* cited by examiner

*Primary Examiner*—Bruce H Hess
(74) *Attorney, Agent, or Firm*—Kelly Lowry & Kelley, LLP

(57) ABSTRACT

An identification device in the form of a wristband, labels, tags or cards, including a clear thermal sensitive coating laminated between a clear plastic coating and a liner ply having colored regions or printed matter. The colored regions or printed matter is visible through the clear thermal sensitive coating and clear plastic coating until the thermal sensitive coating is activated and becomes selectively opaque. The clear plastic coating having a uniform thickness allows for reliable thermal printing on the thermal sensitive coating with the clear plastic coating in place.

23 Claims, 2 Drawing Sheets

PRINTABLE IDENTIFICATION MEDIUM FOR USE WITH THERMAL PRINTERS

BACKGROUND OF THE INVENTION

This invention relates generally to printable identification media, namely, wristbands, labels and cards. More specifically, this invention relates to such media having a thermal sensitive coating and a protective transparent coating.

Current identification devices having thermal sensitive coatings place the thermal coating as a top layer of several layers so that the thermal coating is easily activated with thermal printheads. Some prior art devices provide a protective layer including a coating or varnish to protect the thermal layer from damage by solvents or other materials. Such varnishes are cured by ultraviolet light, can result in varying thickness following manufacture, and can result in a darker image. The darker image results because the thermal sensitive coating is not a fixed distance from the thermal print head due to the varying thickness of the varnish. This variation in distance results in a thermal sensitive coating with a greater degree of activation in areas where the over coat varnish is thinner and a lesser degree of activation in areas where the over coat varnish is thicker. Such varnishes are also soluble in certain chemicals, hand sanitizers and alcohols found in environments such as hospitals, bars, etc.

Such coatings or varnishes are problematic due to manufacturing inconsistencies such as coating thicknesses, chemical reactions with liquids that the final product may come into contact with and inconsistencies in the chemical makeup of the coating. Such issues are of greater concern to users of the products in environments where the device may come into contact with potentially damaging compounds. In one environment, healthcare facilities, the identification device may be exposed to alcohol, creams and/or gels that are harmful to the thermal or varnish layer. Another example of a harsh environment is water parks where chemicals like chlorine and exposure to harmful UV rays are present and can damage the thermal layer. The exposure to UV light and oxygen reduces the print quality and causes the print to "fade" prematurely. This is a critical problem with direct thermal printed cards, labels, tags and wristbands.

Therefore, there is a need for an identification device having a thermally activated layer that is adequately protected from harsh environments both chemical and ultraviolet. Further, there is a need for an improved coating or varnish for such thermally activated layers that will protect them from solvents or chemicals that may be used in those environments. The present invention fulfills these needs and provides other related advantages.

SUMMARY OF THE INVENTION

The present invention resides in a printable identification medium for use with thermal printers. The identification medium comprises a flexible base substrate having a colored region or printed matter on a top surface. A transparent thermal activation layer made from a thermal sensitive coating overlies the flexible base substrate. A transparent top layer overlies the transparent thermal activation layer. The flexible base substrate may comprise a mono-, bi-, or tri-laminate material. Preferably, the transparent thermal activation layer becomes selectively opaque when activated. The transparent thermal activation layer may create printed matter or conceal a portion of the underlying colored region or printed matter when it becomes opaque.

The identification medium may include a first transparent adhesive layer and clear plastic layer between the flexible base substrate and the transparent thermal activation layer. The identification medium may also include a second transparent adhesive layer between the transparent thermal activation layer and the transparent top layer. In the absence of either adhesive layer the transparent thermal activation layer may be combined with a transparent adhesive prior to being applied to the flexible base substrate. The adhesive or adhesive layers may comprise an ultraviolet adhesive or a pressure-sensitive adhesive. Where an adhesive is not used in the identification medium the transparent top layer should be laminated to the flexible base substrate in such a way as to maintain the transparent thermal activation layer therebetween. Preferably the transparent thermal activation layer is coated or bonded directly to an underside of the transparent top layer.

The transparent top layer comprises a polymer film of uniform thickness. The polymer film preferably comprises polyester or polyethylene terephthalate or other transparent film. In its most preferred embodiment, the transparent top layer comprises polyethylene terephthalate having a uniform thickness between 0.25 mm and 0.5 mm. The top layer may have a thickness between 0.25 mm and 1.0 mm. This transparent top layer may be impregnated with UV inhibitors and/or anti-oxidants to reduce the effect of ultra violet light and oxidation on the thermal layer.

The identification medium comprises a wristband, a label, tag, or a card. A thermal printer may cause the thermal activation layer to create printed matter, i.e., letters, numbers, characters or symbols. Further, the thermal activation layer may be configured to become a plurality of opaque colors when activated. The color may vary based upon either the type of thermal sensitive coating comprising the layer or the energy signal produced by the thermal printer.

The present invention also resides in a process for manufacturing a printable identification medium for use with thermal printers. The process begins with providing a flexible base substrate having a colored region or printed matter on a top surface. A transparent thermal activation layer is then placed on the top surface of the flexible base substrate. Finally, a transparent top layer overlies the transparent thermal activation layer. The thermal activation layer may be bonded directly to an underside of the top layer.

As described above, a transparent adhesive layer may be applied to the flexible base substrate before placing the transparent thermal activation layer. Such transparent adhesive layer may comprise an ultraviolet adhesive or a pressure-sensitive adhesive. Alternatively, a transparent adhesive may be mixed with the transparent thermal activation layer before adhering same to the flexible base substrate. Also the transparent thermal activation layer could be bonded directly to the under side of the transparent top layer to eliminate the inconsistencies of the transparent adhesive layer. With this embodiment, the transparent thermal activation layer will always be a fixed distance from the print head and will eliminate manufacturing inconsistencies Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENTS

The present invention is concerned with a printable identification medium for use with thermal printers. More specifically, the present invention is directed to identification wristbands, labels, tags or cards that are capable of being printed with the use of a thermal printer and have a protective coating to guard against damage by environmental hazards.

Figure 1:
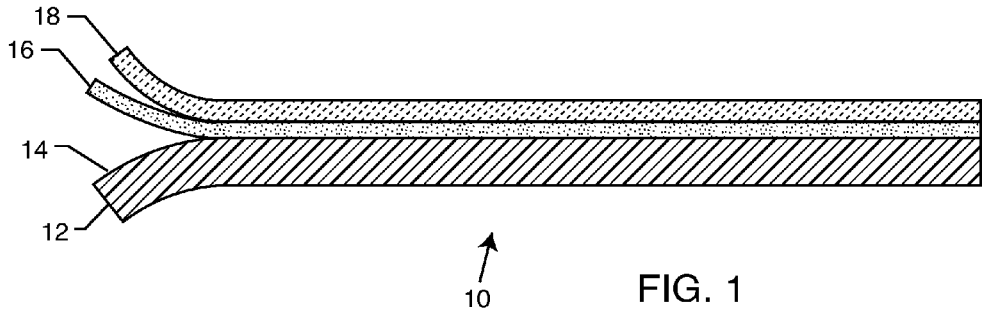
FIG. 1 is a cross-sectional view of a preferred embodiment of an identification device of the present invention.
Figure 2:
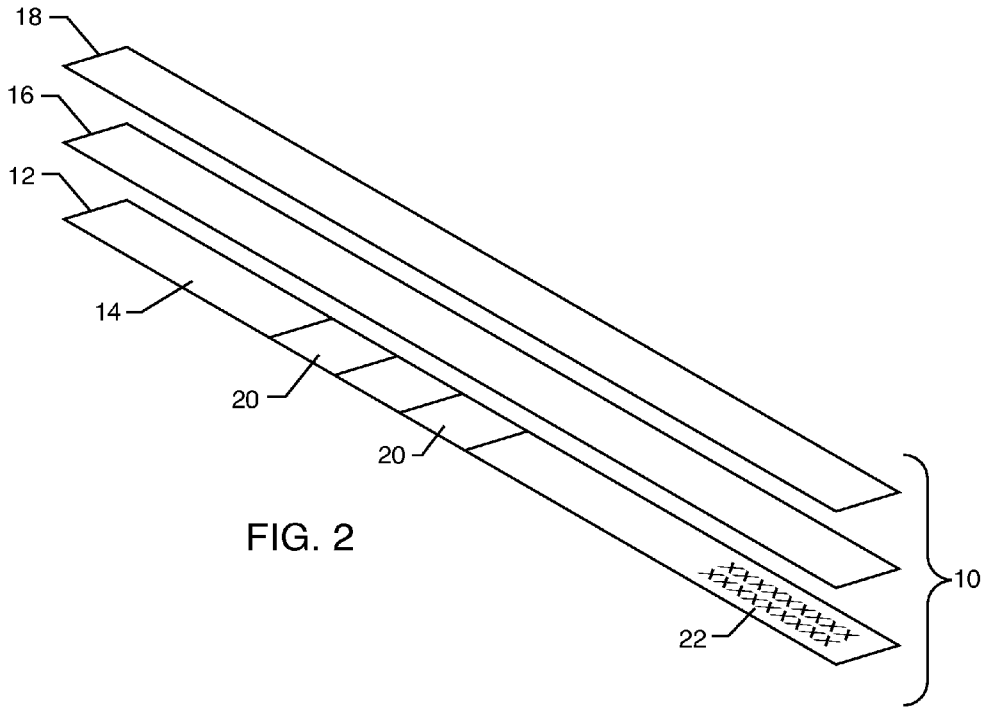
FIG. 2 is an exploded perspective view of the identification device of FIG. 1.

FIGS. 1 and 2 depict a preferred embodiment of an identification medium 10 of the present invention. This embodiment shows three layers laminated together—a flexible base substrate or liner layer 12 having a top surface 14, a transparent thermal activation layer 16, and a transparent top layer 18. The top surface 14 may include one or more colored regions 20 and/or printed matter 22. The colored regions 20 may comprise any color of the spectrum, including white and black. Since the thermal activation layer 16 and top layer 18 are both transparent, the colored regions 20 and printed matter 22 are visible therethrough.

The transparent thermal activation layer 16 becomes selectively opaque when activated. Preferably, the transparent thermal activation layer 16 is activated by a thermal printer (as described below) in selected areas such that it conceals a portion of the colored regions 20 and/or printed matter 22 when it becomes opaque. In this way, a user may selectively activate the transparent thermal activation layer 16 to selectively conceal one or more colored regions 20 and/or a portion or all of the printed matter 22. It is intended that after the selective activation of the thermal activation layer 16 only those portions of the colored regions 20 and printed matter 22 which are applicable to the wearer of the identification medium 10 remain visible through the transparent layers 16, 18.

The thermal activation layer 16 is preferably bonded directly to an underside of the top layer 18. This assures better performance because the thermal activation layer 16 is closer to the top layer 18 and less insulated from the print head. If the thermal activation layer 16 is placed on the liner layer 12 and the top layer 18 is then overlaid, the thermal activation layer 16 may vary in its distance from the upper surface of the print head along the length of the identification medium 10.

The thermal activation layer 16 may be configured such that when it is activated it becomes opaque in a color contrasting the color of the liner layer 12. Activation of the thermal activation layer 16 may be selectively performed such that printed matter, i.e., indicia, symbols or shapes, may be created thereon.

The flexible base substrate or liner layer 12 is made from any flexible, durable film or polymer commonly used in similar identification devices. Preferably, the liner layer 12 is comprised of a mono-, bi- or tri-laminate film. The material that comprises the liner layer 12 may be impregnated with colored ink or may receive printed matter on an exposed surface as described above.

Figure 3:
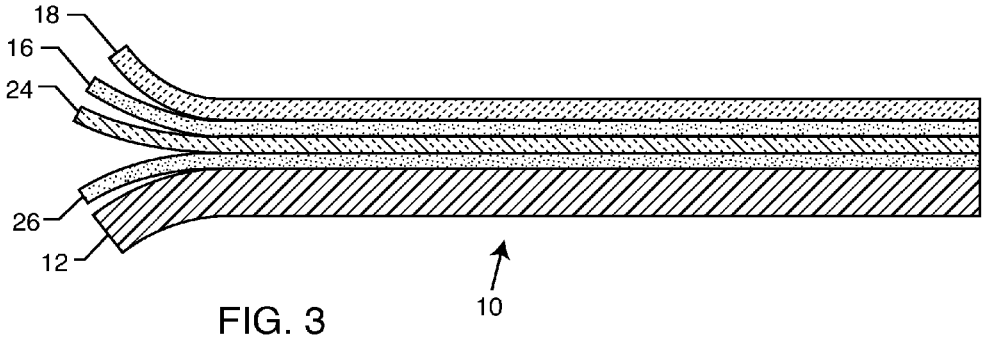
FIG. 3 is a cross-sectional view of an alternate embodiment of an identification device of the present invention.

As shown in FIG. 3, a clear plastic layer 24 may be adhered to the liner layer 12 by a transparent adhesive layer 26. The clear layer 24 is adhered to the top surface 14 such that it covers and protects the colored regions 20 and printed matter 22. This coverage and protection assures that the colored regions 20 and printed matter 22 remain as applied during the remainder of the manufacturing process. Because the thermal activation layer 16 and top layer 18 are both disposed on top of the clear layer 24, the clear layer 24 and adhesive layer 26 will not interfere with the function of the thermal activation layer 16.

Another transparent adhesive layer (not shown) may be included to adhere the top layer 18 to the thermal activation layer 16. The adhesive layer 26 may be a pressure sensitive, ultraviolet, or other commonly used adhesive. The selected adhesive must be one that will not be damaged or otherwise impaired by the heat from the thermal printer. The clear plastic layer 24 may be any form of clear plastic laminate commonly used in such identification devices 10.

As discussed above, the first adhesive layer 26 or second adhesive layer (not shown) may be omitted from the identification device. The reason for eliminating either adhesive layer would be to avoid a manufacturing step or eliminate inconsistencies. If either adhesive layer is omitted, then the lamination of the liner layer 12 to the transparent top layer 18 should be of sufficient strength and durability to maintain the thermal activation layer 16 and/or clear layer 24 therebetween.

Alternatively, the thermal activation layer 16 may be combined with an adhesive prior to application to the liner layer 12 or clear layer 24. In this manner, the activation layer 16 self-adheres to the liner layer 12 or clear layer 24 and transparent top layer 18 without the need for a separate adhesive layer.

The thermal activation layer 16 can be made from any thermal sensitive coating used with thermal printers. The thermal activation layer 16 needs to be capable of activation by a thermal printer print head 32. Once activated, the effect of the thermal activation layer 16 may vary. In the most basic embodiment, the thermal activation layer 16 is configured to turn opaque when activated. As described above, when the thermal activation layer becomes opaque it conceals the underlying colored regions 20 or printed matter 22 on the top surface 14 of the liner layer 12. Alternatively, the thermal activation layer 16 may print black letters, numbers, characters or symbols according to the signals sent to the thermal printer. The thermal activation layer 16 may also be designed to print different colors according to the type of thermal sensitive coating or energy signal 34 produced by the thermal printer.

The transparent top layer 18 is preferably polyester, polyethylene terephthalate (PET) or other strong, thin film. The transparent top layer 18 of the present invention should be of uniform thickness, assuring that the thermal activation layer 16 is a known fixed distance from the print head 32 over its entire length. This uniformity of thickness in the transparent top layer 18 results in more consistent activation of the thermal activation layer 16 along its length. The transparent top layer 18 is resistant to chemicals and solvents found in the harsh environments discussed above. The transparent top layer 18 could also be impregnated with ultra-violet (UV) inhibitors and/or anti-oxidants to reduce exposure of the thermal activation layer 16 to harmful UV light sources and oxidation. This will have the effect of longer lasting printed information 22.

The transparent top layer 18 may have a thickness up to 1.0 mm. In a preferred embodiment, the transparent top layer 18 is PET between 0.25 millimeters and 0.5 millimeters thick. This thickness of PET provides sufficient protection of the thermal activation layer 16 against environmental hazards while producing consistent print results.

Figure 4:
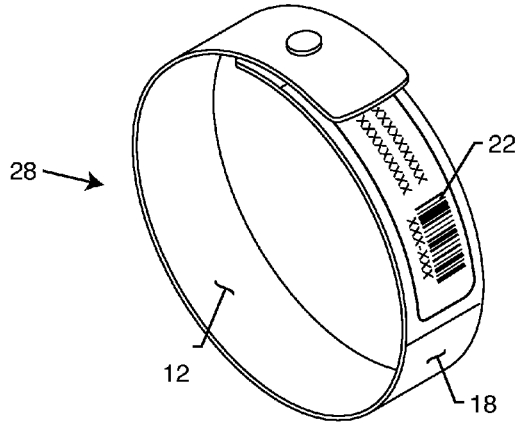
FIG. 4 is a perspective view of a wristband embodying the present invention.
Figure 5:
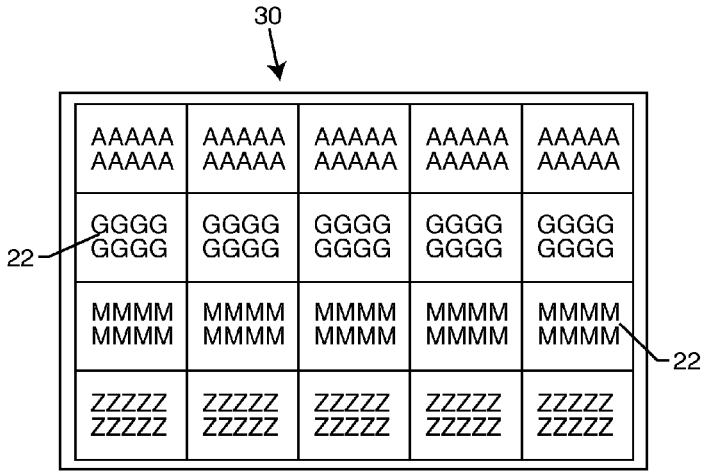
FIG. 5 is a perspective view of a sheet of labels embodying the present invention.
Figure 6:
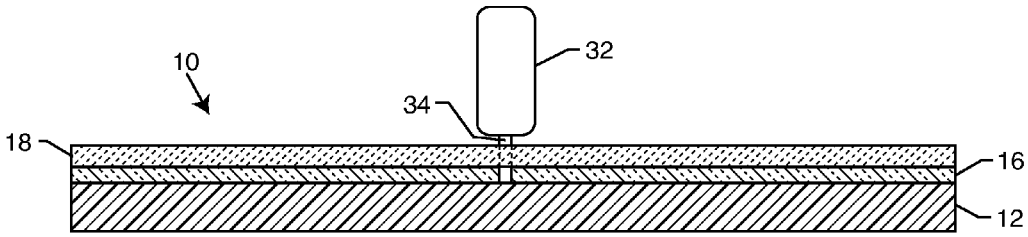
FIG. 6 is a cross-sectional view of a thermal printhead activating the thermal layer of an identification device embodying the present invention.

FIGS. 4 and 5 depict perspective views of a wristband 28 and a sheet of labels 30 respectively, each embodying the present invention. FIG. 6 illustrates a print head 32 from a thermal printer (not shown) activating the thermal activation layer 16 of an identification device 10 embodying the present invention. As illustrated, the energy 34 from the thermal print head 32 passes through the transparent top layer 18 and activates the thermal activation layer 16.

Although particular embodiments of the invention have been described in detail for purposes of illustration, various modifications may be made without departing from the scope and spirit of the invention. Accordingly, the invention is not to be limited, except as by the appended claims.

What is claimed is:

1. A printable identification medium for use with thermal printers, comprising:

a flexible base substrate;

a transparent thermal activation layer comprising a thermal sensitive coating overlying the flexible base substrate;

a transparent top layer comprising a polymer film overlying the thermal activation layer; and a transparent adhesive layer and a clear plastic layer between the flexible base substrate and the thermal activation layer.

2. The printable identification medium of claim 1, wherein the flexible base substrate comprises a mono-laminate, bi-laminate or tri-laminate material.

3. The printable identification medium of claim 1, wherein the adhesive layer comprises an ultraviolet adhesive or a pressure-sensitive adhesive.

4. The printable identification medium of claim 1, wherein the identification medium comprises a wristband, a label, or a card.

5. The printable identification medium of claim 1, wherein the flexible base substrate has a colored region or printed matter thereupon and the transparent thermal activation layer overlies the colored region or printed matter.

6. The printable identification medium of claim 5, wherein the thermal activation layer selectively becomes opaque when activated to conceal a portion of the colored region or printed matter on the flexible base substrate.

7. The printable identification medium of claim 1, wherein the thermal activation layer becomes one of a plurality of opaque colors when activated.

8. The printable identification medium of claim 1, wherein the thermal activation layer selectively creates printed matter when activated.

9. The printable identification medium of claim 1, wherein the polymer film is of uniform thickness and comprises polyester.

10. The printable identification medium of claim 9, wherein the top layer comprises polyethylene terephthalate having a thickness between 0.25 mm and 0.5 mm.

11. The printable identification medium of claim 1, wherein the top layer self-adheres or is laminated to the flexible base substrate such that the thermal activation layer is maintained therebetween.

12. The printable identification medium of claim 1, wherein the thermal activation layer is bonded directly to an underside of the top layer.

13. The printable identification medium of claim 1, wherein the top layer includes ultra-violet inhibitors or anti-oxidants.

14. A process for manufacturing a printable identification medium for use with thermal printers, comprising the steps of:

providing a flexible base substrate;

placing a transparent thermal activation layer on the flexible base substrate;

overlaying a transparent top layer comprising a polymer film on the flexible base substrate; and applying a transparent adhesive layer and clear plastic layer to the flexible base substrate before the placing step.

15. The process of claim 14, wherein the transparent adhesive layer comprises an ultraviolet adhesive or a pressure-sensitive adhesive.

16. The process of claim 14, further comprising the step of mixing a transparent adhesive with the transparent thermal activation layer before the placing step.

17. The process of claim 14, wherein the flexible base substrate comprises a mono-laminate, bi-laminate or tri-laminate material.

18. The process of claim 14, wherein the identification medium comprises a wristband, a label, a tag or a card.

19. The process of claim 14, wherein the flexible base substrate has a colored region or printed matter thereupon and the transparent thermal activation layer is placed on the colored region or printed matter.

20. The process of claim 19, wherein the polymer film comprises polyester.

21. The process of claim 20, wherein the polymer film comprises polyethylene terephthalate having a thickness between 0.25 mm and 0.5 mm inclusive.

22. The process of claim 14, wherein the transparent top layer is of uniform thickness.

23. The process of claim 14, further comprising the step of bonding the thermal activation layer directly to an underside of the top layer prior to the placing step.

* * * * *